US007112007B2

(12) United States Patent
Maffett et al.

(10) Patent No.: US 7,112,007 B2
(45) Date of Patent: Sep. 26, 2006

(54) CRADLE FOR ITEM TRANSPORTATION AND STORAGE, ESPECIALLY WATERCRAFT STORAGE

(76) Inventors: William C. Maffett, 8 S. Madison Ave., Cookeville, TN (US) 38501; Brian D. Maffett, 8 S. Madison Ave, Cookeville, TN (US) 38501

( * ) Notice: Subject to any disclaimer, the term of this patent is extended or adjusted under 35 U.S.C. 154(b) by 47 days.

(21) Appl. No.: 10/899,384

(22) Filed: Jul. 26, 2004

(65) Prior Publication Data

US 2005/0035259 A1 Feb. 17, 2005

Related U.S. Application Data

(60) Provisional application No. 60/490,066, filed on Jul. 25, 2003.

(51) Int. Cl.
*B63C 3/12* (2006.01)

(52) U.S. Cl. ..... 405/3

(58) Field of Classification Search ..... 405/3–7
See application file for complete search history.

(56) References Cited

U.S. PATENT DOCUMENTS

| | | | | |
|---|---|---|---|---|
| 1,515,435 A | * | 11/1924 | Glover | 405/7 |
| 3,341,164 A | * | 9/1967 | Ewing, Jr. | 405/7 |
| 3,385,458 A | | 5/1968 | Gresham | 214/16.4 |
| 3,786,942 A | | 1/1974 | Dane, Jr. | 214/16.4 |
| 3,802,580 A | | 4/1974 | Castaldi | 214/16.4 |
| 4,070,979 A | | 1/1978 | Otis et al. | 114/263 |
| 4,190,013 A | | 2/1980 | Otis et al. | 114/263 |
| 4,227,828 A | * | 10/1980 | Ivanov et al. | 405/7 |
| 4,268,207 A | | 5/1981 | Pipes | 414/277 |
| 4,372,724 A | | 2/1983 | Stolzer | 414/281 |
| 4,488,847 A | | 12/1984 | Stolzer | 414/222 |
| 4,640,214 A | | 2/1987 | Bruns | 114/263 |
| 4,726,316 A | | 2/1988 | Bruns | 114/263 |
| 4,787,804 A | | 11/1988 | Edenas | 414/281 |

(Continued)

FOREIGN PATENT DOCUMENTS

| | | |
|---|---|---|
| FR | 2552411 | 3/1985 |

(Continued)

OTHER PUBLICATIONS

Brochure "Marinas and Small Craft Harbors," authored by Tobiasson and Kollmeyer, published by Van Nostrand Reinhold, NY.

*Primary Examiner*—Frederick L. Lagman
(74) *Attorney, Agent, or Firm*—Waddey & Patterson, P.C.; Phillip E. Walker

(57) ABSTRACT

A cradle assembly for moving and positioning an item with respect to a support module in a storage assembly with the item including a bottom. The cradle assembly comprises a plurality of cradle beams, at least one cradle wall vertically extending upward from the plurality of cradle beams, and at least one stanchion vertically extending upward from one of the cradle beams. A padded support is operatively attached to the stanchion and positioned to engage the bottom of the item as a cradle assembly moves the item with respect to the support module. A positioning system is operatively connected to the padded support to horizontally and vertically position the padded support with respect to the plurality of the cradle beams to selectively engage the bottom of the item. Each stanchion and padded support includes a reciprocal stanchion and padded support, wherein positioning system selectively spaces the reciprocal padded supports from each other a width that is less than the width of the item being transported.

20 Claims, 11 Drawing Sheets

U.S. PATENT DOCUMENTS

| | | | | |
|---|---|---|---|---|
| 4,797,055 | A | 1/1989 | Tworoger et al. | 414/283 |
| 4,953,488 | A | 9/1990 | Heidtmann | 114/44 |
| 4,971,505 | A | 11/1990 | Sawyer | 414/232 |
| 4,979,869 | A | 12/1990 | Mullin, Jr. | 414/786 |
| 5,011,357 | A | 4/1991 | Studler | 414/253 |
| 5,238,348 | A | 8/1993 | Reimer | 414/254 |
| 5,487,636 | A | 1/1996 | Mkrtchyan | 414/286 |
| 5,882,170 | A | 3/1999 | Walton | 414/462 |
| 6,007,288 | A | 12/1999 | Maffett et al. | 414/281 |
| 6,099,014 | A | 8/2000 | McLaughlin | 280/414.1 |
| 6,162,003 | A * | 12/2000 | Gruner | 414/281 |
| 6,189,909 | B1 | 2/2001 | Danchuk | 280/414.1 |
| 6,263,820 | B1 | 7/2001 | Crifase et al. | 114/219 |
| 6,327,990 | B1 | 12/2001 | Crifase et al. | 114/219 |
| 6,446,997 | B1 | 9/2002 | Bergman et al. | 280/414.3 |
| 6,490,987 | B1 | 12/2002 | Crifase et al. | 114/219 |
| 6,520,728 | B1 | 2/2003 | Schwitters | 414/467 |
| 6,612,602 | B1 | 9/2003 | MacKarvich | 280/414.1 |
| 6,644,231 | B1 | 11/2003 | Crifase et al. | 114/219 |
| 6,719,317 | B1 | 4/2004 | Grovender et al. | 280/414.1 |
| 6,752,099 | B1 | 6/2004 | Crifase et al. | 114/219 |
| 2002/0176767 | A1 | 11/2002 | Gisselberg | 414/261 |

FOREIGN PATENT DOCUMENTS

| | | | |
|---|---|---|---|
| GB | 882343 | 11/1961 | 414/254 |
| JP | 2-048311 | 2/1990 | |
| JP | 2-088853 | 3/1990 | 414/254 |
| JP | 2-183055 | 7/1990 | |
| JP | 2-241891 | 9/1990 | 414/254 |
| JP | 3-119270 | 5/1991 | 414/254 |

* cited by examiner

CRADLE FOR ITEM TRANSPORTATION AND STORAGE, ESPECIALLY WATERCRAFT STORAGE

CROSS-REFERENCES TO RELATED APPLICATIONS

This application is a Non-Provisional Utility application which claims benefit of co-pending U.S. patent application Ser. No. 60/490,066 filed Jul. 25, 2003, entitled "Improved Cradle For A Watercraft Storage System" which is hereby incorporated by reference in its entirety.

BACKGROUND OF THE INVENTION

The present invention relates generally to cradle assemblies for moving items into and out of storage, especially the movement of items with irregular bottoms, or lower regions, into which a cradle assembly engages. More particularly, but not by way of limitation, the present invention relates to an improvement to a cradle assembly for the dry storage of watercraft.

The current improvement to such cradle assemblies enhances the engagement between the cradle assembly and the bottom, or hull, of the watercraft. Specifically the improvement includes adjustable supports designed to be aligned within the cradle to substantially conform to the general shape of the hull of the watercraft in order to better engage, support and transport the watercraft.

It will be appreciated by those skilled in the art that watercraft transportation devices have existed for many years. However, most of these transportation devices are in the form of trailers or land anchored platforms that use the watercraft's power and/or a crank to pull the watercraft out of the water by its bow. For example U.S. Pat. Nos. 6,612,602, 6,099,014, 5,882,170, 6,520,728, 6,189,909, 6,446,997, 6,719,317, 6,752,099, 6,644,231, 6,490,987, 6,327,990, and 6,263,820, all disclose such transportation devices.

Additionally, the dry storage of watercraft is becoming increasingly popular over the years. This dry dock storage includes a stacked or vertical arrangement of vertical watercraft lifted from the water's surface and placed in the stacked arrangements. For example, U.S. Pat. No. 6,007,288, which is hereby incorporated by reference in its entirety, discloses one such watercraft storage system. However, the conventional art has a drawback based on the wide variety of watercraft that is currently popular. This wide variety of watercraft varies in length, depth and width along with various undulations and configurations that comprise the hulls of these watercraft. As such, any lifting apparatus used to place the watercraft from the water surface into the storage system should be able to handle this wide variety of watercraft. However, currently the surfaces of the lifting apparatus in the conventional systems that move the watercraft from the water surface to the dry storage area lack the capability and flexibility to vary their engagement locations in order to adapt to the variance in the hulls of the watercraft.

As such, what is lacking in the art is a cradle assembly that can vary its engagement locations to substantially adapt to the variance in the bottoms, or hulls, of watercraft in order to transport that watercraft to a storage area.

The present invention provides for an adjustable cradle support system that can be either manually adjusted or automatically adjusted to accommodate a larger selection of boats. The system can be preprogrammed in an unloaded state, to fit the popular boat bottom configurations. This adjustment can be computerized to make the adjustment prior to moving the boat into its birth or launching into the water. The automation of this system can be setup by bar code, card number, punch code or magnetic tape card and possibly a number of different identification systems. Once a user actuates the automated system, his particular boat can be identified and a series of electric motors can be actuated to operate drive shafts to position the screw drives so that roller support will fit beneath the boat hull and be positioned to lift the boat out of the water and moved to its racked position.

BRIEF SUMMARY OF THE INVENTION

Disclosed herein is a cradle assembly for moving and positioning an item with respect to a support module in a storage assembly with the item including a bottom. The cradle assembly comprises a plurality of cradle beams, at least one cradle wall vertically extending upward from the plurality of cradle beams, and at least one stanchion vertically extending upward from one of the cradle beams. Additionally, the cradle assembly comprises a padded support operatively attached to the stanchion and positioned to engage the bottom of the item as a cradle assembly moves the item with respect to the support module. Also, the cradle assembly comprises a positioning system operatively connected to the padded support to horizontally and vertically position the padded support with respect to the plurality of the cradle beams to selectively engage the bottom of the item. The cradle assembly also includes a first and second side wherein each stanchion and padded support positioned proximate to the first side includes a reciprocal stanchion and padded support positioned proximate to the second side. As such, the positioning system selectively spaces the reciprocal padded supports from each other a width that is less than the width of the item being transported.

In an embodiment the cradle assembly is used to move and position a watercraft with respect to a support module positioned in a watercraft storage assembly wherein the watercraft has an irregular bottom. In this embodiment the padded support is pivotally connected to the stanchion and moveable in both a horizontal and vertical direction with respect to the cradle beams. Additionally, a guidearm is pivotally attached to the stanchion and the padded support wherein the guidearm is positioned to horizontally and vertically vary the alignment of the padded support with respect to the cradle beams. The positioning system is operatively connected to the guidearm to rotate the guidearm about the attachment in between the guidearm and the stanchion such that the rotation of the guidearm by the positioning system varies the location of the padded support with respect to the cradle beams.

In a preferred embodiment the padded support is a pair of guide rollers rotatively attached to the guidearm for protective gripping of the watercraft. Additionally, the adjacent cradle beams are spaced a distance apart and the pair of guiderollers substantially spans that distance. Additionally, the pair of guiderollers can be rotatively connected to adjacent cradle beams in order to span the distance between the cradle beams.

In an alternative embodiment the padded support is slideably connected to the stanchion and moveable in a vertical direction with respect to the plurality of cradle beams. The padded support is pivotably connected to the stanchion to vary the orientation of the padded support with respect to the cradle beams and the padded support is a polyurethane pad for protective gripping of the watercraft. Additionally, the stanchion itself is slideably connected to one of the cradle beams and is horizontally positionable with respect to that cradle beam.

As such it is an object of the present invention to provide a cradle assembly for moving and positioning items with respect to a support module in a storage assembly.

Another object of the present invention is to provide a cradle assembly for moving and positioning a watercraft with respect to a support module and a watercraft storage assembly wherein the watercraft includes an irregular bottom.

Yet another object of the present invention is to provide a cradle assembly having a padded support area that is moveable to selectively engage the hulls of various watercrafts.

And yet still another object of the present invention is to provide a cradle assembly that includes a positioning system that can align ports to the best support locations on the hull of a watercraft.

Other and further objects features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

FIG. 6 shows examples of various positionings and engagements of padding supports to the bottom of watercraft.

DETAILED DESCRIPTION OF THE INVENTION

Figure 1:
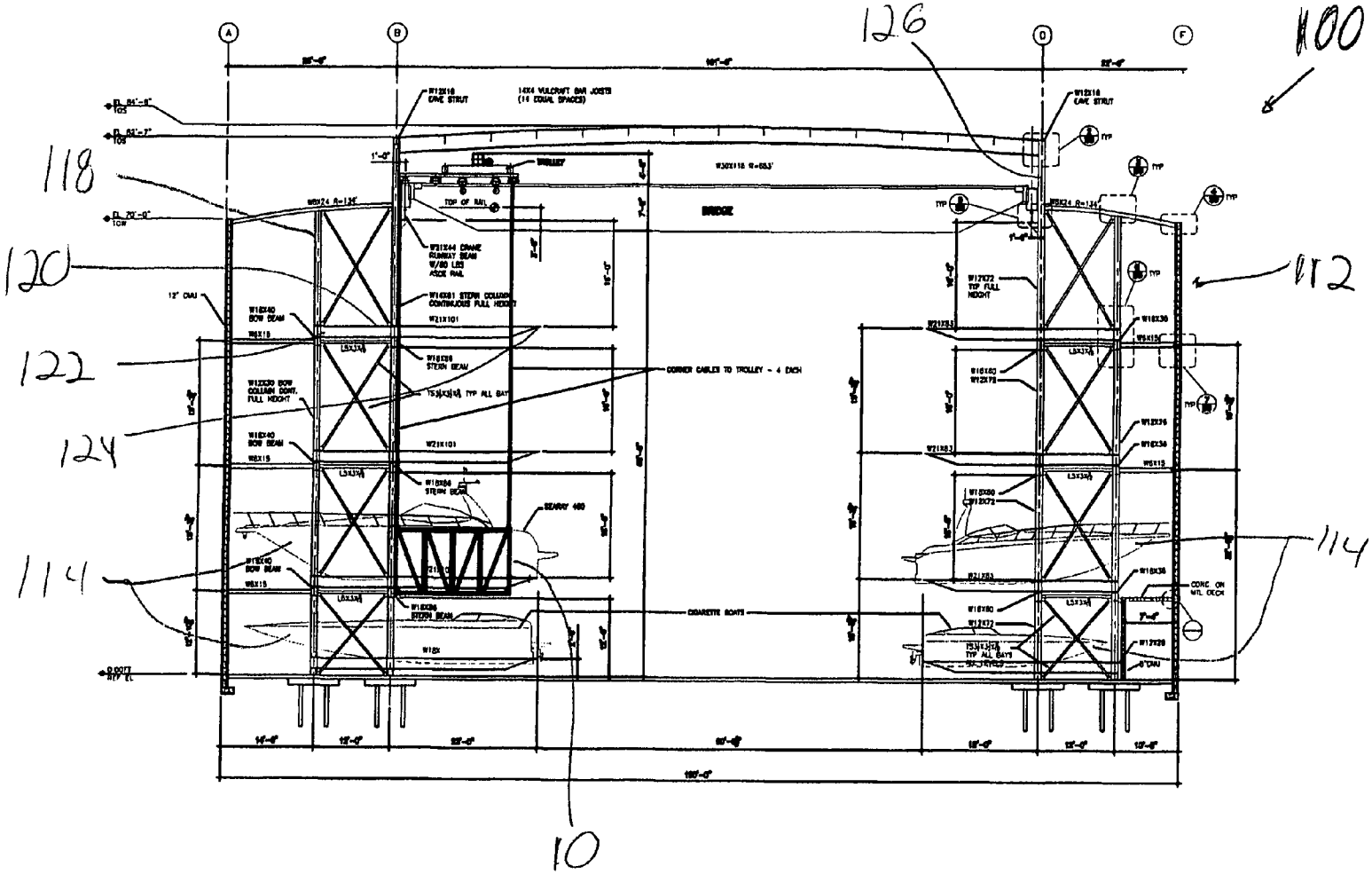
FIG. 1 is an end view of an embodiment of a watercraft storage assembly shown with various support modules and watercraft types positioned therein.
Figure 2:
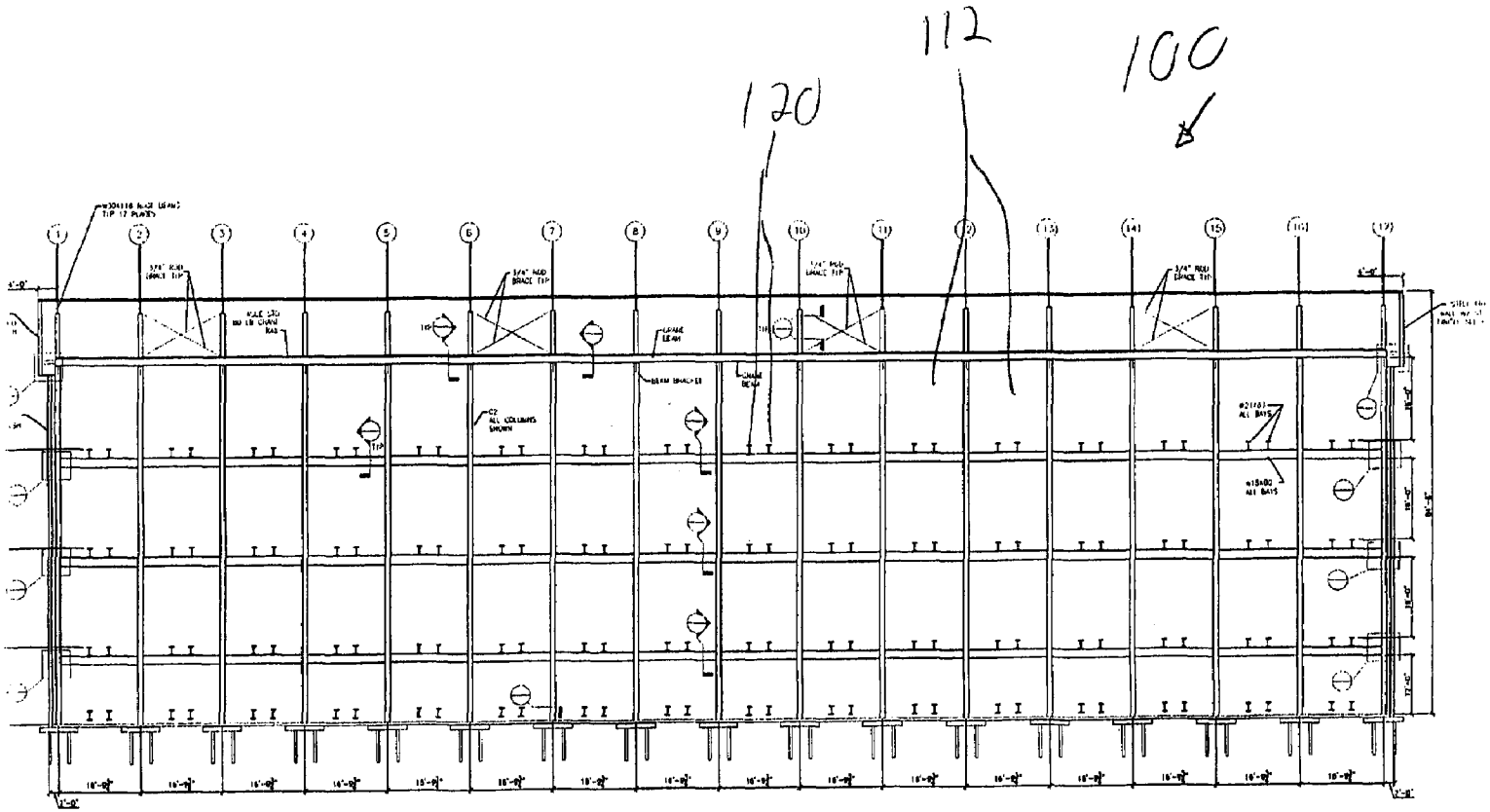
FIG. 2 is a side sectional view of an embodiment of a storage assembly with various support modules stacked therein.
Figure 3:
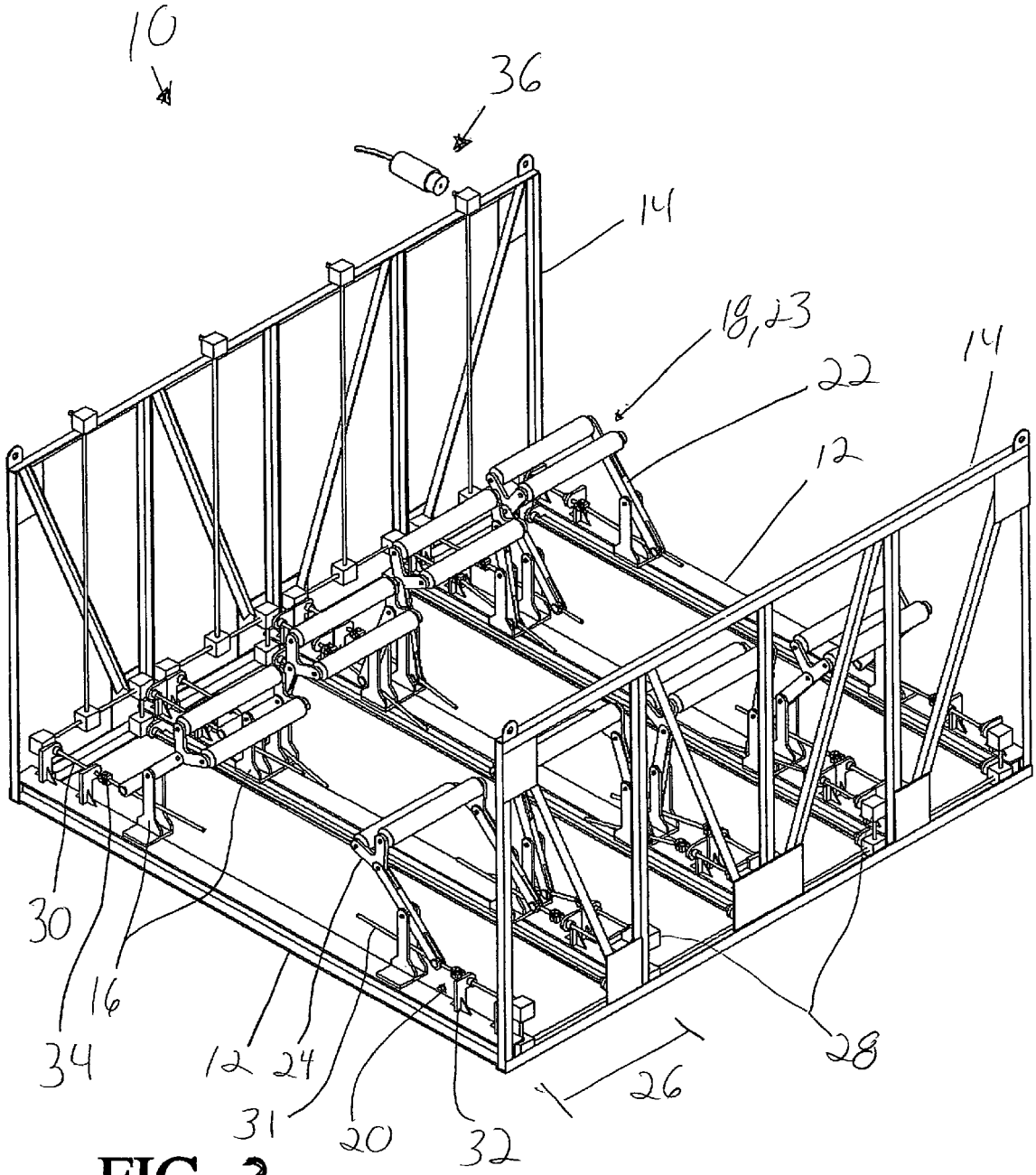
FIG. 3 is a perspective view of an embodiment of a cradle assembly made in accordance with the current invention.
Figure 4:
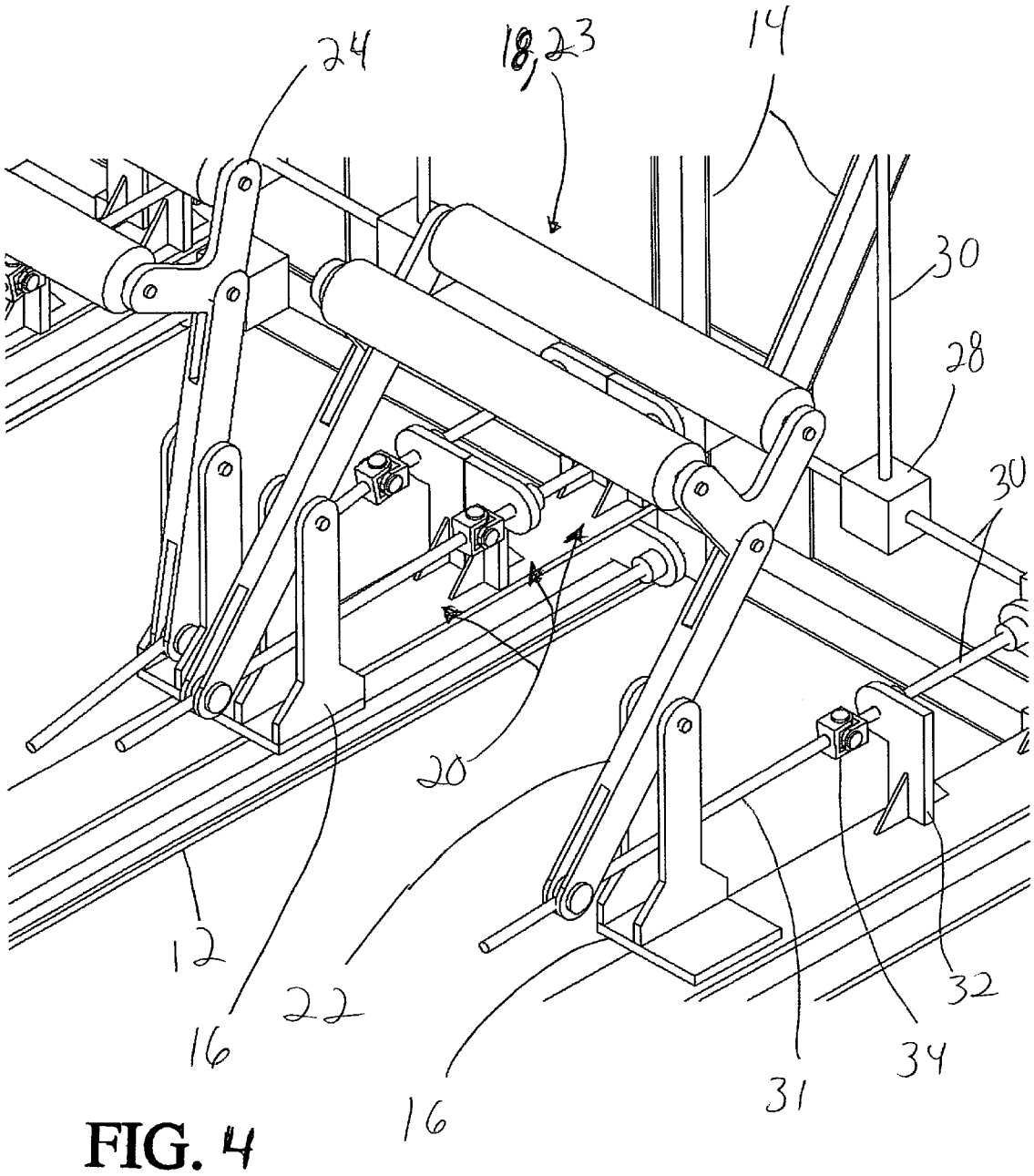
FIG. 4 is a partial detailed view of one embodiment of a stanchion, padded support, and positioning system made in accordance with the current invention.

Referring now generally now to FIGS. 1–12, a cradle assembly is generally shown and designated by the numeral 10. The cradle assembly (10) is for moving and positioning an item (114) with respect to a support module (112) in a storage assembly (100). The item (114) includes a bottom (116) that can be irregularly shaped. Preferably the item (114) is a watercraft and the support module (112) is in a watercraft storage assembly. The storage assembly (100) preferably includes a support wall (118), at least two support modules (112) mounted and stacked in a relationship to the support wall (118) wherein each support module (112) includes a pair of cantilever beams (120) having opposing ends (122 and 124). The first opposing end (122) is attached to the support wall (118), while the other opposing end (124) cantilevers out from the support wall (118). Additionally a remote support unit (126) is spaced from the support wall (118) in a direction of the opposing end (124). The remote support unit (26) extends beyond the opposing end (124) of the pair of cantilever beams (120).

The cradle assembly (10) comprises a plurality of cradle beams (12), at least one cradle wall (14) vertically extending upward from one of the cradle beams (12), and at least one stanchion (16) vertically extending upward from one of the cradle beams (12). Additionally, the cradle assembly (10) comprises a padded support (18) operatively attached to the stanchion (16) and positioned to engage the bottom (116) of the watercraft (114) as the cradle assembly (10) moves the watercraft (114) with respect to the support module (112). Additionally, a positioning system (20) is operatively connected to the padded support (18) to position the padded support (18) to selectively engage the bottom (116) of the watercraft (114). The padded support (18) is pivotally connected to the stanchion (16) and moveable in both a horizontal and vertical direction with respect to the cradle beams (12).

In a preferred embodiment the cradle assembly (10) further includes a guidearm (22) pivotally attached to the stanchion (16) and the padded support (18). The guidearm (22) is positioned to horizontally and vertically vary the alignment of the padded support (18) with respect to the cradle beams (12). The positioning system (20) is operatively connected to the guidearm (22) to rotate the guidearm (22) about the attachment between the guidearm (22) and the stanchion (16). This rotation of the guidearm (22) by the positioning system (20) varies the location of the padded support (18) with respect to the cradle beams (12).

The padded supports (18) provide contact and support to a watercraft (114). The padded supports (18) nest with the various types of bottoms (116) for the watercraft (114), such as platoons, tri-hulls, catamaran, cigarette boats, and other various types of flotation devices. The padded supports (18) can provide automatic, gravity activated positioning to substantially align to the slope of the bottom (116) of the watercraft (114), including the length (48) and width (50). The multiple banks of padded supports (18) adjust for the deadrise and step in the bottom (116) of the watercraft (114).

In this embodiment the padded support (18) is a pair of guide rollers rotatably attached to the guidearm (22) by an armature (24), which is preferably "V" shaped. The armature (24) facilitates the engagement of the pair of guiderollers (23) to the bottom (116), or hull (116), of the watercraft (114). The armatures (24) can have a spring loaded attachments to the guidearms (22). Additionally, the pair of guiderollers (23) protects and grips the watercraft (114).

The adjacent cradle beams (12) are spaced a distance (26) apart and the pair of guiderollers (23) substantially spans that distance (26). Most preferably, the pair of guiderollers (23) is rotatively connected to the adjacent cradlebeams (12) and, as such, substantially spans the entire distance (26). The various steps, crease and curvatures of the bottom (116) of the watercraft (114) can fit within the gap between the pair of guiderollers (23).

The rotateable attachment of the armature (24) to the guidearm (22) allows the pivoting of the pair of guiderollers (23) with respect to the guidearm (22). Additionally, the pivotal attachment between the guidearm (22) and the stanchion (16) allows a rotation of the guidearm (22) about that pivotable attachment between the guidearm (22) and the stanchion (16).

The positioning system (20) includes a plurality of gear boxes (28) that can include motors used to drive the various aspects of the cradle assembly (10). The gear boxes (28) are operatively attached to various drive rods (30) used to transmit the power and movement from the gear boxes (28) to the stanchion (16) and padded supports (18). The drive rods (30) are supported by rod supports (32). The positioning system (20) can be manually or automatically controlled. For example, the gearboxes (28) can be used in conjunction with the electric motors but can also be manually driven, such as with levered screwdriver handles, or hydraulically driven with pumps and controllers.

Additionally, the drive rods (30) are connected to moveable drive rods (31) by to the universal joints (34). The moveable drive rods (31) engage the guidearms (22) in order to transmit movement to the guidearms (22) and subsequently the pair of guided rollers (23). The drive rods (30) can extend upward within the cradle walls (14) as needed to properly control and operate the cradle assembly (10). A control connection (36) can be used to link the positioning system (20) to a remote location wherein the user can control the cradle assembly (10).

Figure 5:
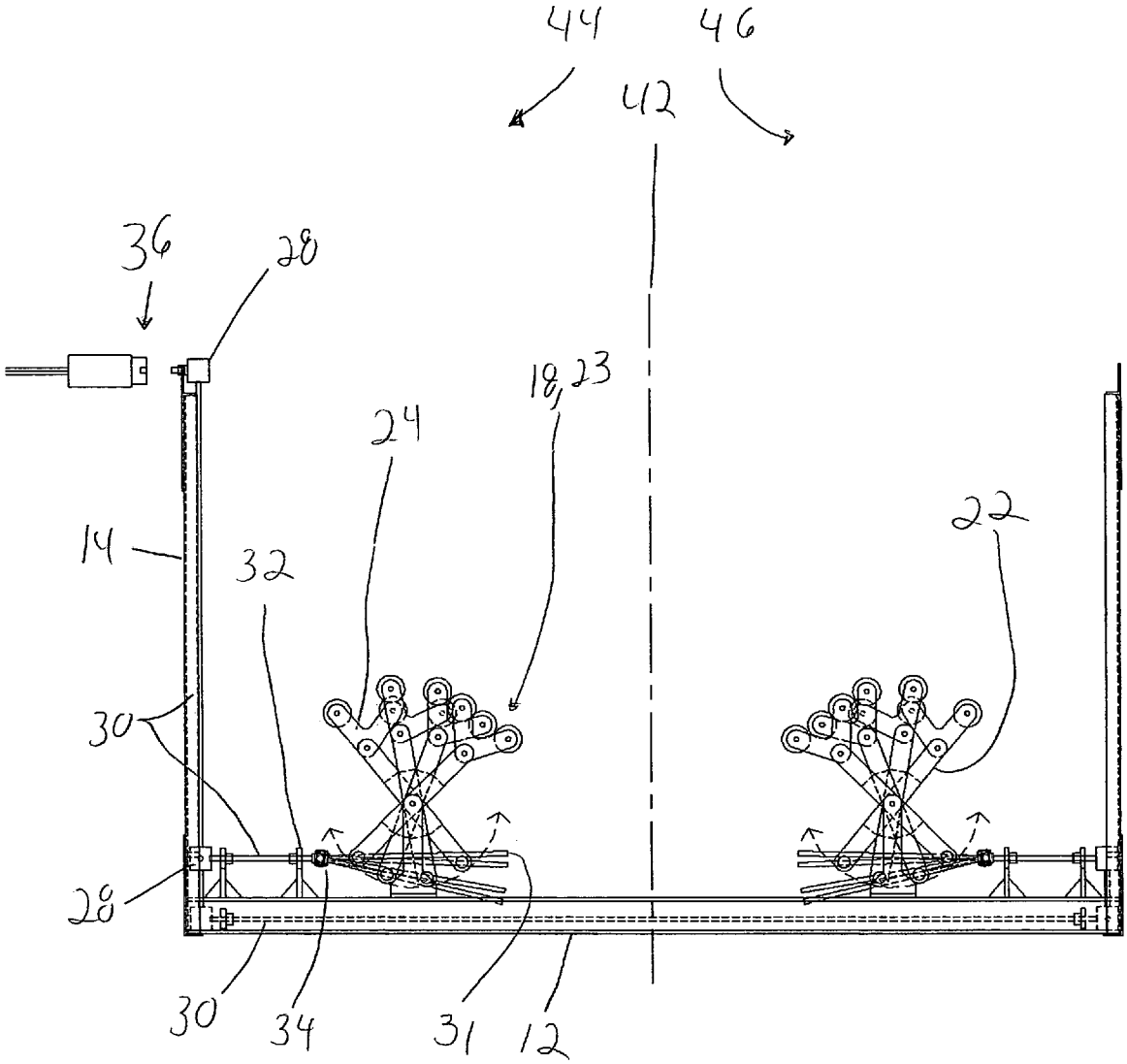
FIG. 5 is an end view of one embodiment of the current invention showing an example of the various positionings of the padded support in a cradle assembly made in accordance with the current invention.
Figure 6:
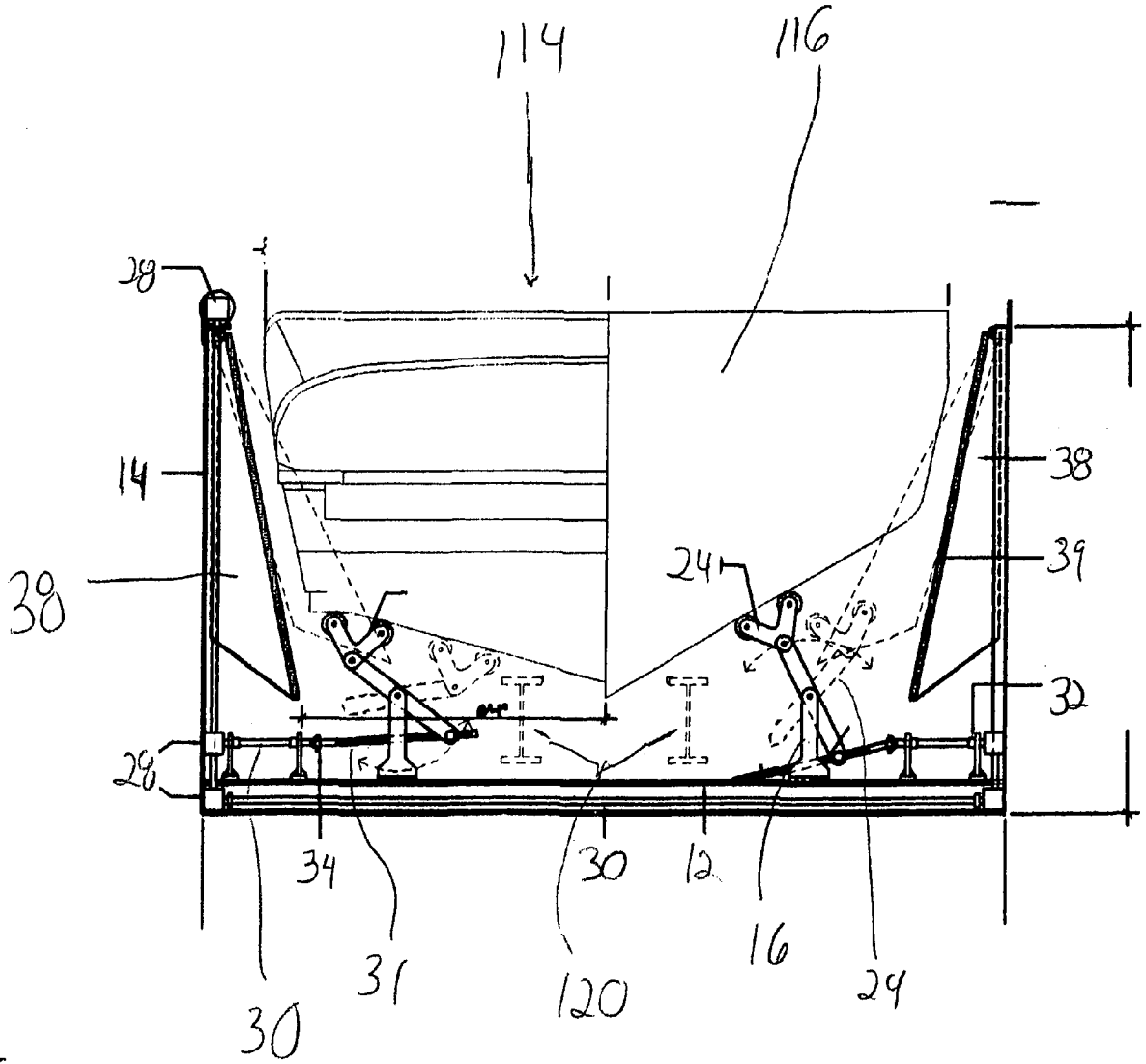
FIG. 6 is an end view similar to FIG. 5.
Figure 7:
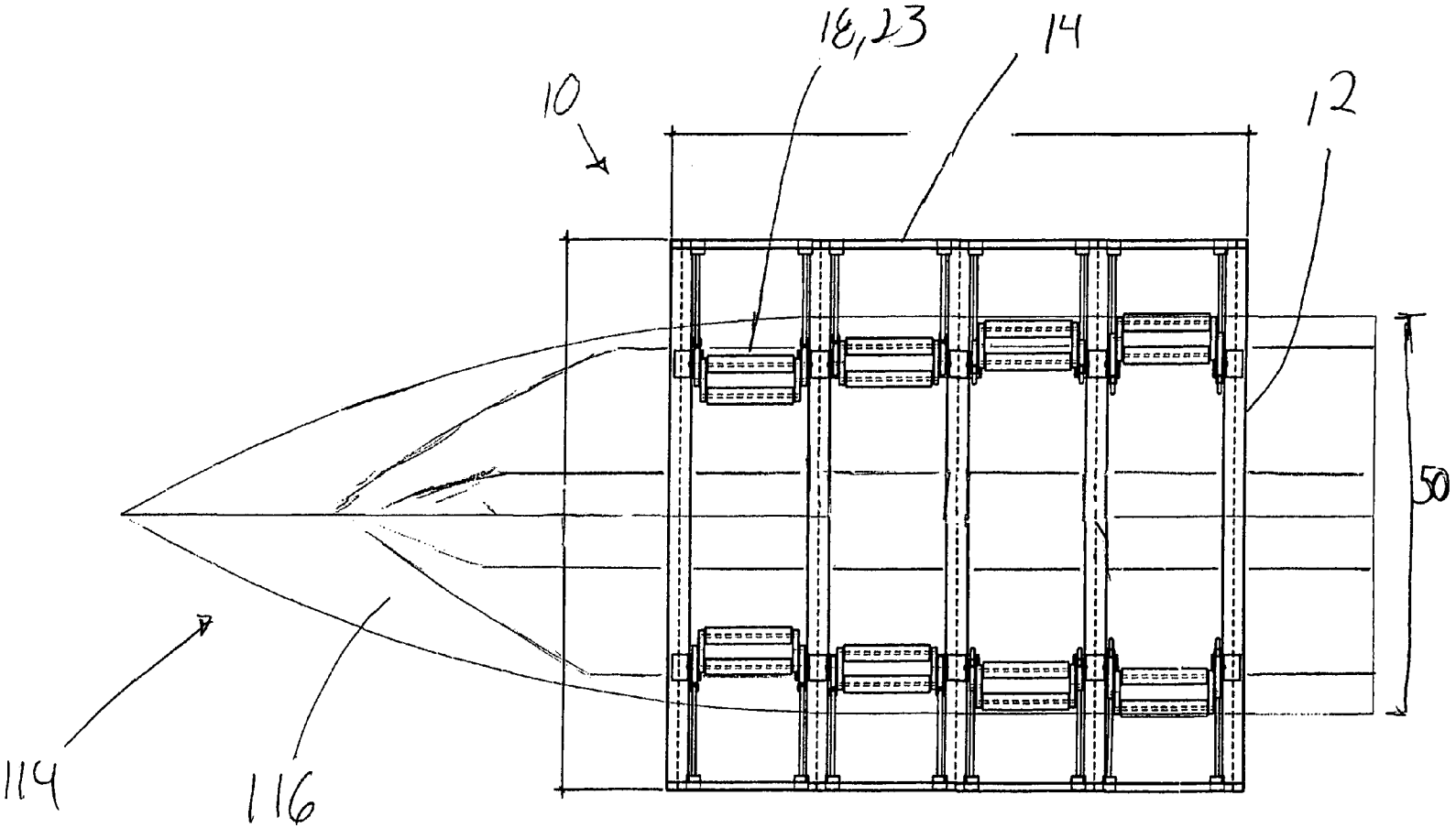
FIG. 7 is a bottom view of an embodiment of a cradle assembly made in accordance with the current invention shown supporting the bottom of watercraft.
Figure 8:
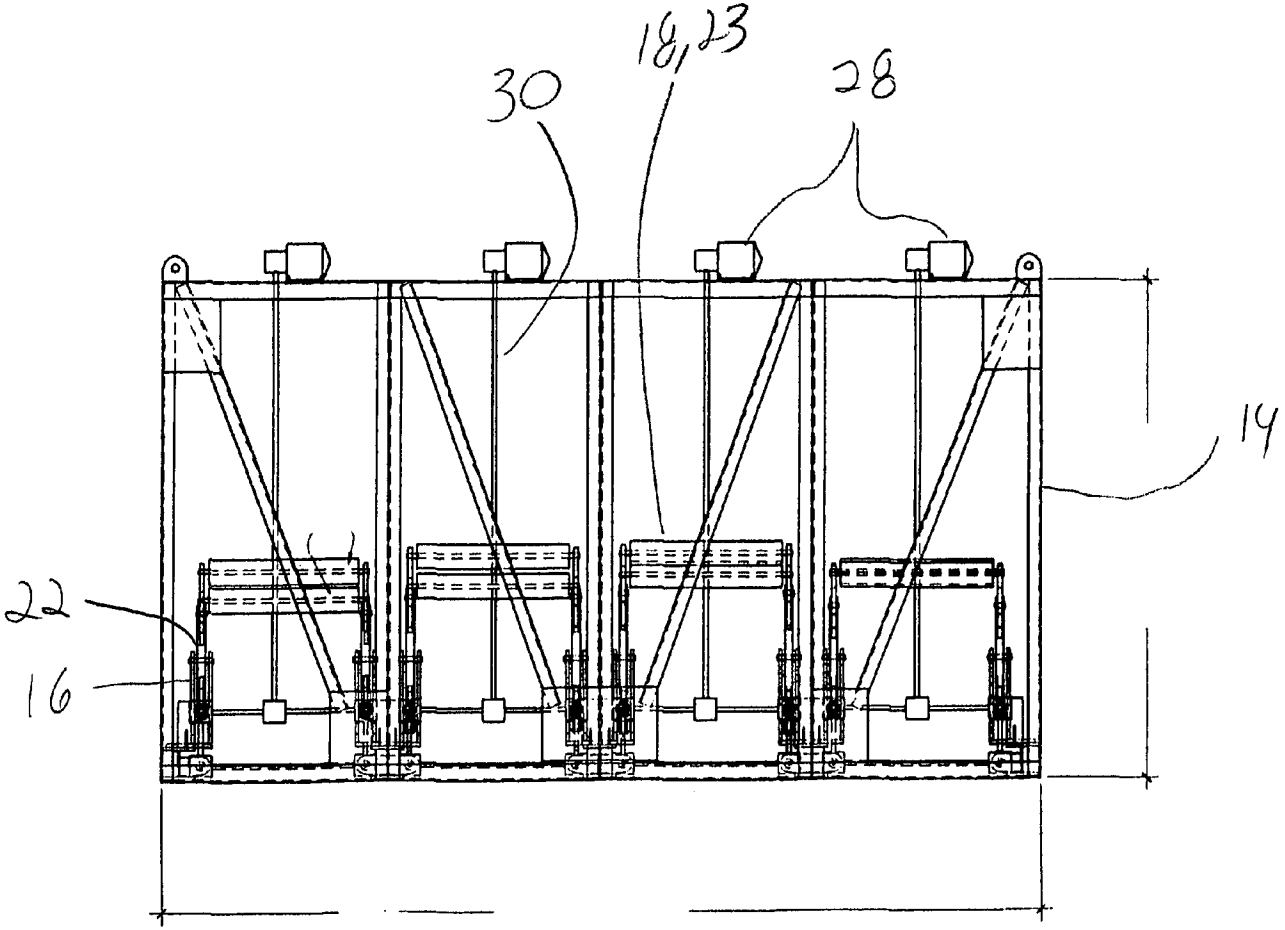
FIG. 8 is a side view of an embodiment of the cradle assembly shown in FIGS. 3–7.
Figure 9:
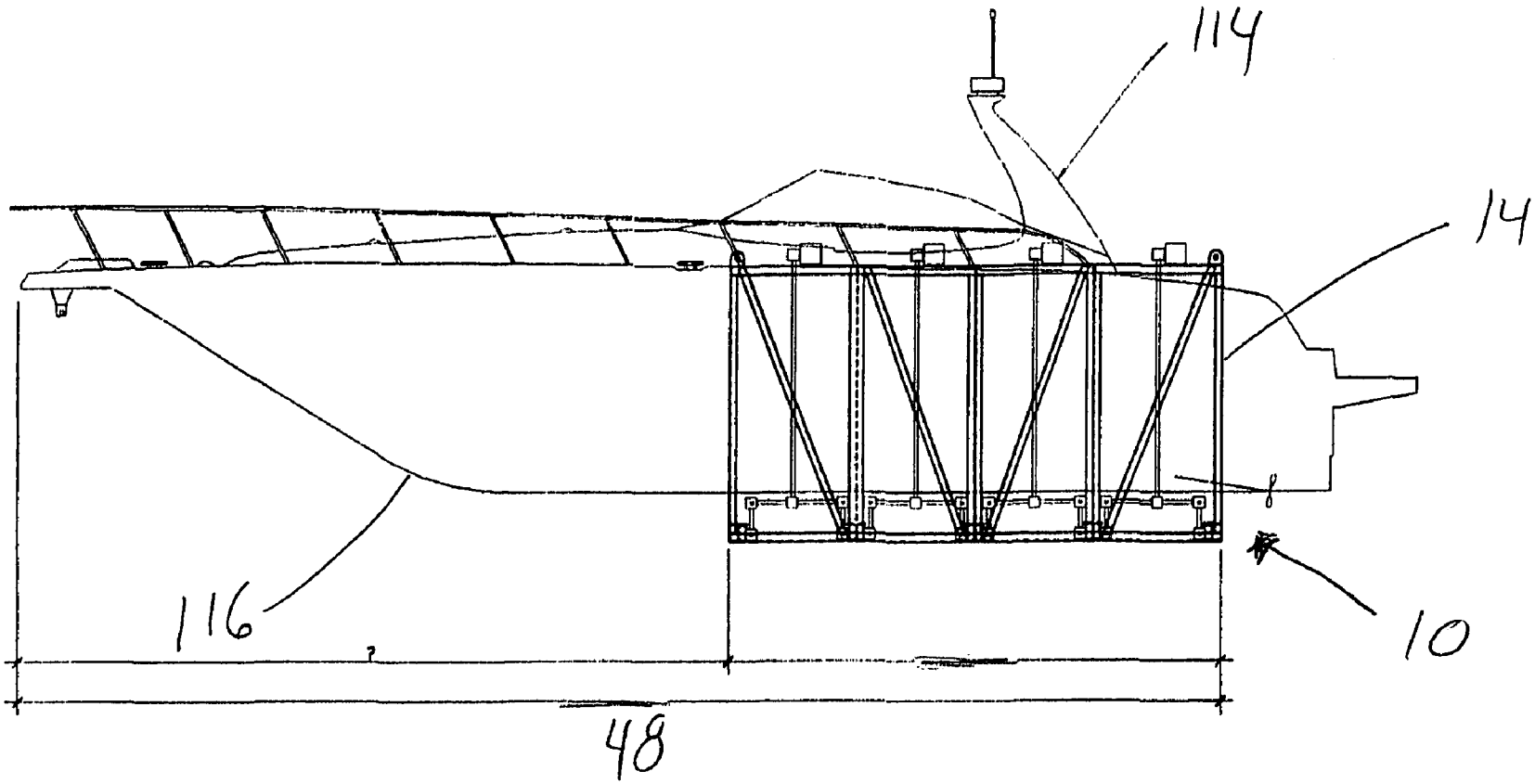
FIG. 9 is a side elevation view of an embodiment of the cradle assembly as shown in FIGS. 3–8 shown supporting a watercraft.
Figure 10:
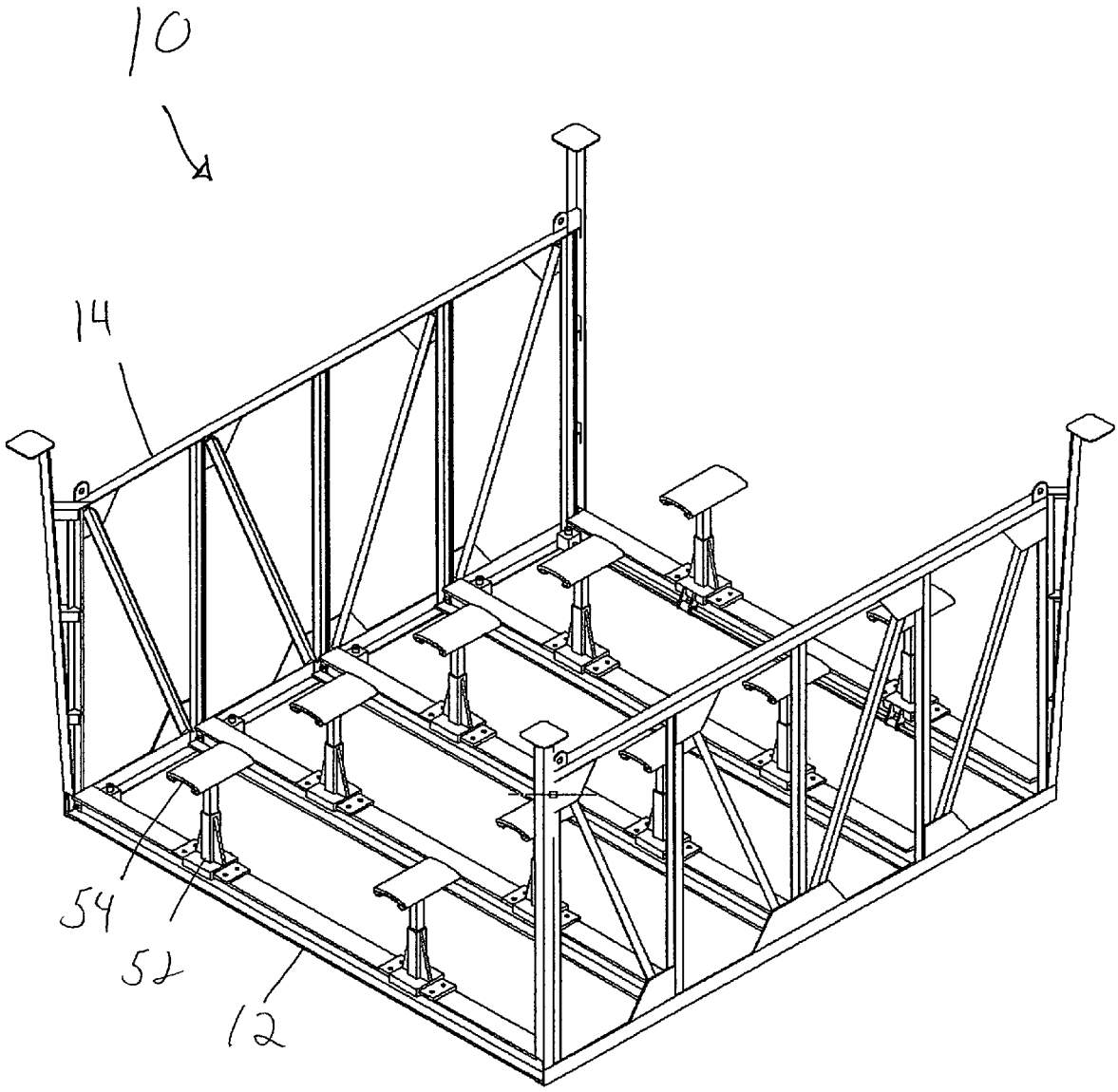
FIG. 10 is a perspective view of an alternate embodiment of a cradle assembly made in accordance with the current invention.
Figure 11:
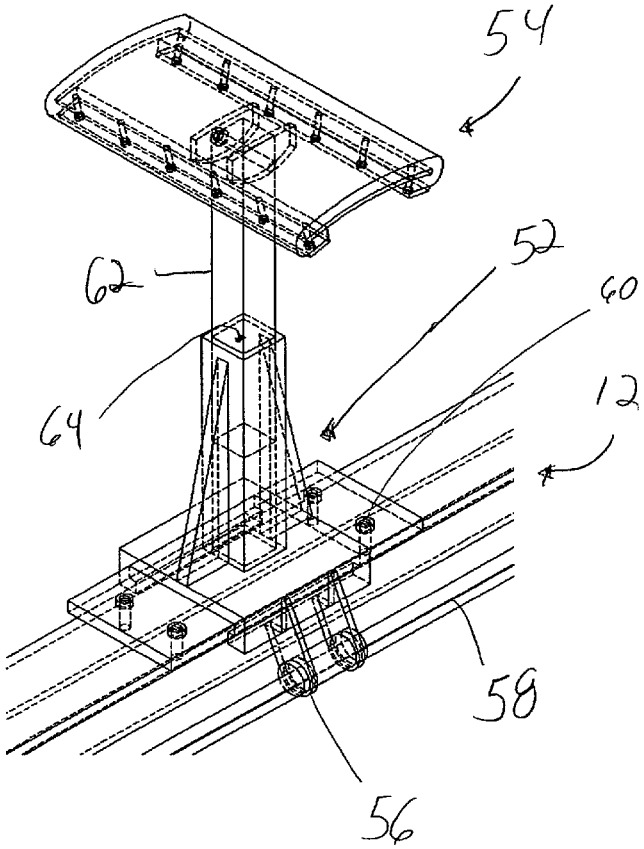
FIG. 11 is a perspective view of an alternate stanchion and padded support made in accordance with the current invention.
Figure 12:
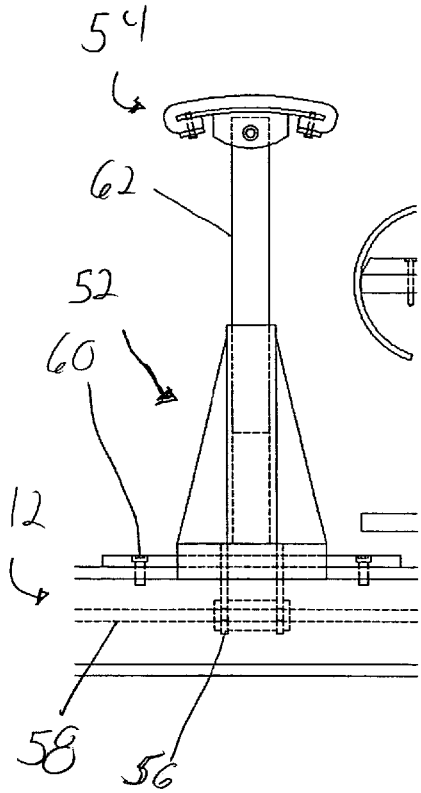
FIG. 12 is a side view of an alternate stanchion and padded support made in accordance with the current invention.

As best seen in FIGS. 5 and 6, as the preferably threaded moveable drive rods (31) rotate the guidearm (22), the armature (24) translates along the length of the moveable drive rod (31). This translation causes the guidearm to rotate (22) and, as such, reposition the pair of guiderollers (23). The universal joint (34) allows the moveable drive rod (31) to pivot about the universal joint (34) allowing proper translation of the guidearm (22) along the moveable drive rod (31) and proper rotation about the guidearm's (22) connection to the stanchion (16).

Additionally, the cradle assembly (10) includes a floating centering assembly (38) attached to the cradle wall (14). The floating centering assembly (38) comprises at least a pair of buoyant arms (40) to direct the watercraft (114) to the center (42) of the cradle assembly (10) by applying pressure to the sides of the watercraft (114). The floating centering assembly (38) can include padding (39), or carpeting (39), to protect the engagement between the floating centering assembly (38) and the watercraft (114).

The cradle assembly (10) further includes a first side (44) and a second side (46) wherein each stanchion (16) and padded support (18) that is positioned proximate to the first side (44) includes a reciprocal stanchion (16) and padded support (18) positioned proximate to the second side. Alternately stated, the stanchion (16) and padded supports (18) have an opposing stanchion (16) and padded support (18) in order to provide proper support and weight distribution for the watercraft (114).

Additionally, the watercraft (114) can have a length (48) wherein the bottom (116) varies along the length (48). The positioning system (20) is aligned within the cradle assembly (10) to selectively position each padded support (18) to correspond to the variance along the length (48) of the bottom (116) of the watercraft (114). Additionally, the watercraft includes a width (50) wherein the positioning system (20) selectively spaces the reciprocal padded supports (18) from each other a distance, or a width, that is less than the width (50) of the watercraft (114).

In an alternate embodiment the cradle assembly (10) includes a stanchion (52) that is slideably connected to one of the cradle beams (12) such that the stanchion (52) is horizontally positionable with respect to the cradle beam (12). Additionally, this cradle assembly (10) includes a padded support (54) that is slideably connected to the stanchion (52) and moveable in a vertical direction with respect to the cradle beam (12). The stanchion (52) can include a threaded receptor (56) attached to a threaded drive rod (58) used to slide the stanchion (52) with respect to the cradle beam (12). Additionally the stanchion (52) can include alignment pin (60) used to facilitate the positioning of the stanchion (52) on the cradle beam (12).

The padded support (54) comprises a tubular stem (62) designed to mate with an opening (64) in the stanchion (52). The tubular stem (62) can be positioned with respect to the opening (64) by pins, fasteners, clamps and other devices known in the art to removeably fix objects in relationship to one another. This padded support (54) is pivotally fixed to the tubular stem (62). As such the orientation of the padded support (54) can vary with respect to the cradle beam (12). In this embodiment the padded support (54) is preferably a polyurethane pad for protected gripping of the watercraft (114).

Thus, although there have been described particular embodiments of the present invention of a new and useful "Improved Cradle For Item Transportation Especially Watercraft Storage", it is not intended that such references be construed as limitations upon the scope of this invention except as set forth in the following claims.

What is claimed is:

1. A cradle assembly for moving and positioning a watercraft with respect to a support module in a watercraft storage assembly, the watercraft including a bottom, the cradle assembly comprising a plurality of cradle beams;

at least one cradle wall vertically extending upward from one of the cradle beams;

at least one stanchion vertically extending upward from one of the cradle beams;

a padded support operatively attached to the at least one stanchion and positioned to engage the bottom of the watercraft as the cradle assembly moves the watercraft with respect to the support module;

a positioning system operatively connected to the padded support to position the padded support to selectively engage the bottom of the watercraft; and wherein adjacent cradle beams are spaced a distance apart and the padded support substantially spans that distance.

2. The cradle assembly of claim 1, wherein the padded support is pivotally connect to the stanchion and movable in both a horizontal and a vertical direction with respect to the plurality of cradle beams.

3. The cradle assembly of claim 1, further including a guide arm pivotally attached to the stanchion and the padded support and positioned to horizontally and vertically vary the alignment of the padded support with respect to the plurality of cradle beams.

4. The cradle assembly of claim 3, wherein the positioning system is operatively connected to the guide arm to rotate the guide arm about the attachment between the guide arm and the stanchion.

5. The cradle assembly of claim 4, wherein the rotation of the guide arm by the positioning system varies the location of the padded support with respect to the plurality of cradle beams.

6. The cradle assembly of claim 5, wherein the padded support is a pair of guide rollers rotatably attached to the guide arm for protected gripping of the watercraft.

7. The cradle assembly of claim 1, wherein the cradle assembly includes a first and second side and each stanchion and padded support positioned proximate the first side includes a reciprocal stanchion and padded support positioned proximate the second side.

8. The cradle assembly of claim 7, wherein:

the watercraft includes a length and the bottom of the watercraft varies along the length; and the positioning system is aligned to selectively position each padded support to correspond to the variance on the bottom of the watercraft.

9. The cradle assembly of claim 8, wherein:

the watercraft includes a width, and the positioning system selectively spaces the reciprocal padded supports from each other a width less than the width of the watercraft.

10. A cradle assembly for moving and positioning a watercraft with respect to a support module in a watercraft storage assembly, the watercraft including a bottom, the cradle assembly comprising a plurality of cradle beams;

at least one cradle wall vertically extending upward from one of the cradle beams;

at least one stanchion vertically extending upward from one of the cradle beams;

a padded support operatively attached to the at least one stanchion and positioned to engage the bottom of the watercraft as the cradle assembly moves the watercraft with respect to the support module;

a positioning system operatively connected to the padded support to position the padded support to selectively engage the bottom of the watercraft;

further including a guide arm pivotally attached to the stanchion and the padded support and positioned to horizontally and vertically vary the alignment of the padded support with respect to the plurality of cradle beams;

wherein the positioning system is operatively connected to the guide arm to rotate the guide arm about the attachment between the guide arm and the stanchion;

wherein the rotation of the guide arm by the positioning system varies the location of the padded support with respect to the plurality of cradle beams;

wherein the padded support is a pair of guide rollers rotatably attached to the guide arm for protected gripping of the watercraft; and wherein adjacent cradle beams are spaced a distance apart and the pair of guide rollers substantially spans that distance.

11. The cradle assembly of claim 10, wherein the pair of guide rollers are rotatably connected to adjacent cradle beams.

12. A cradle assembly for moving and positioning a watercraft with respect to a support module in a watercraft storage assembly, the watercraft including a bottom, the cradle assembly comprising a plurality of cradle beams;

at least one cradle wall vertically extending upward from one of the cradle beams;

at least one stanchion vertically extending upward from one of the cradle beams;

a padded support operatively attached to the at least one stanchion and positioned to engage the bottom of the watercraft as the cradle assembly moves the watercraft with respect to the support module;

a positioning system operatively connected to the padded support to position the padded support to selectively engage the bottom of the watercraft; and wherein the stanchion is slideably connected to the one of the cradle beams and horizontally positionable with respect to one of the cradle beams.

13. The cradle assembly of claim 12, wherein the padded support is slideably connect to the stanchion and movable in a vertical direction with respect to the plurality of cradle beams.

14. The cradle assembly of claim 13, wherein the padded support is pivotally connect to the stanchion to vary the orientation of the padded support with respect to the plurality of cradle beams.

15. The cradle assembly of claim 14, wherein the padded support is a polyurethane pad for protected gripping of the watercraft.

16. A cradle assembly for moving and positioning a watercraft with respect to a support module in a watercraft storage assembly, the watercraft including a bottom, the cradle assembly comprising a plurality of cradle beams;

at least one cradle wall vertically extending upward from one of the cradle beams;

at least one stanchion vertically extending upward from one of the cradle beams;

a padded support operatively attached to the at least one stanchion and positioned to engage the bottom of the watercraft as the cradle assembly moves the watercraft with respect to the support module;

a positioning system operatively connected to the padded support to position the padded support to selectively engage the bottom of the watercraft; and further including a floating centering assembly attached to the cradle wall, the floating centering assembly attached to the cradle wall and comprising at least one pair of buoyant arms to direct the watercraft to the center of the cradle assembly by applying pressure to sides of the watercraft.

17. A cradle assembly for moving and positioning an item with respect to a support module in a storage assembly, the item including a bottom, the cradle assembly comprising a plurality of cradle beams;

at least one cradle wall vertically extending upward from the plurality of cradle beams;

at least one stanchion vertically extending upward from one of the cradle beams;

a padded support operatively attached to the at least one stanchion and positioned to engage the bottom of the item as the cradle assembly moves the item with respect to the support module; and a positioning system operatively connected to the padded support to horizontally and vertically position the padded support with respect to the plurality of cradle beams to selectively engage the bottom of the item;

wherein adjacent cradle beams are spaced a distance apart and the padded support substantially spans that distance; and wherein the stanchion is slideably connected to the one of the cradle beams and horizontally positionable with respect to one of the cradle beams.

18. The cradle assembly of claim 17, wherein the cradle assembly includes a first and second side and each stanchion and padded support positioned proximate the first side includes a reciprocal stanchion and padded support positioned proximate the second side.

19. The cradle assembly of claim 18, wherein the positioning system selectively spaces the reciprocal padded supports from each other a width less than the width of the item.

20. A cradle assembly for use in a watercraft storage system including a support wall, at least two watercraft support modules mounted and stacked in relationship to said support wall, said support modules each including a pair of cantilever beams having opposing ends, one of each set of opposing ends being attached to said support wall and the other end of each set of opposing ends cantilevering out from said support wall, a remote support unit spaced from said support wall in a direction of the other opposing ends of said beams and beyond the said other ends of said beams, the cradle assembly comprising:

a plurality of cradle beams having a left and right side;

a cradle wall vertically extending upward from each side of the cradle beams;

a plurality of stanchions vertically extending upward from each of the cradle beams;

a padded support operatively connect to the stanchion and positionable in both a horizontal and a vertical direction with respect to the plurality of cradle beams to engage the bottom of the watercraft as the cradle assembly moves the watercraft with respect to the cantilever beams; and a positioning system operatively connected to the padded support and aligned to selectively position each padded support to correspond to the variance on the bottom of the watercraft.

* * * * *